US010563930B2

(12) United States Patent
Rede

(10) Patent No.: US 10,563,930 B2
(45) Date of Patent: Feb. 18, 2020

(54) HEAT EXCHANGER INCLUDING COIL END CLOSE-OFF COVER

(71) Applicant: Hussmann Corporation, Bridgeton, MO (US)

(72) Inventor: Jacob J. Rede, Dardenne Prairie, MO (US)

(73) Assignee: Hussmann Corporation, Bridgeton, MO (US)

( * ) Notice: Subject to any disclaimer, the term of this patent is extended or adjusted under 35 U.S.C. 154(b) by 835 days.

(21) Appl. No.: 14/993,715

(22) Filed: Jan. 12, 2016

(65) Prior Publication Data

US 2017/0198986 A1 Jul. 13, 2017

(51) Int. Cl.
*F28F 9/02* (2006.01)
*F28D 1/047* (2006.01)
(Continued)

(52) U.S. Cl.
CPC ..... *F28F 9/0229* (2013.01); *F25B 39/00* (2013.01); *F28D 1/0233* (2013.01); *F28D 1/0477* (2013.01); *F28F 1/325* (2013.01); *F28F 9/06* (2013.01); *F28F 13/06* (2013.01); *F25B 39/02* (2013.01); *F28D 2021/0071* (2013.01)

(58) Field of Classification Search
CPC ..... F28F 9/0229; F28F 1/325; F28F 9/001; F28F 9/06; F28F 13/06; F28F 9/02; F28F 2009/0285; F28F 2009/029; F28F 2280/02; F25B 39/00; F28D 1/0233; F28D 1/0477; F28D 1/047; F28D 7/08
See application file for complete search history.

(56) References Cited

U.S. PATENT DOCUMENTS 375,864 A 1/1888 Brake
844,685 A 2/1907 Long
(Continued)

FOREIGN PATENT DOCUMENTS

EP 2741046 6/2014
FR 2615605 11/1988
(Continued)

OTHER PUBLICATIONS

EP17150908.6 Extended European Search Report dated Aug. 16, 2017 (8 pages).
(Continued)

*Primary Examiner* — Tho V Duong
(74) *Attorney, Agent, or Firm* — Michael Best & Friedrich LLP

(57) ABSTRACT

A heat exchanger assembly including a heat exchanger that has a first end and a second end opposite the first end, and a cover coupled to the second end. The heat exchanger also includes a plurality of fins with a first fin disposed adjacent the first end and a second fin disposed adjacent the second end, and a continuous, serpentine coil. The coil includes first return bends projecting beyond the first fin and second return bends projecting beyond the second fin. The cover has a base plate and separate receptacles encasing one or more of the second return bends to permit airflow through the encased second return bends. The base plate is positioned on the second end to inhibit airflow from one of the receptacles to another of the receptacles.

26 Claims, 11 Drawing Sheets

(51) Int. Cl.

| | |
|---|---|
| ***F28D 1/02*** | (2006.01) |
| ***F28F 1/32*** | (2006.01) |
| ***F28F 13/06*** | (2006.01) |
| ***F25B 39/00*** | (2006.01) |
| ***F28F 9/06*** | (2006.01) |
| *F28D 21/00* | (2006.01) |
| *F25B 39/02* | (2006.01) |

(56) References Cited

U.S. PATENT DOCUMENTS

| | | | | |
|---|---|---|---|---|
| 1,788,068 | A | | 1/1931 | Scott |
| 1,832,147 | A | | 11/1931 | Soule |
| 2,085,677 | A | | 8/1935 | Thayer |
| 2,072,975 | A | | 3/1937 | Winsborough et al. |
| 2,357,156 | A | | 8/1944 | Wilson |
| 2,646,258 | A | | 7/1953 | Freer |
| 2,651,505 | A | * | 9/1953 | Freer ..... B60H 1/00328 165/150 |
| 2,792,201 | A | * | 5/1957 | Whistler, Jr. ..... F28D 1/0477 165/149 |
| 3,267,914 | A | * | 8/1966 | Connell ..... F22B 37/202 122/510 |
| 3,907,026 | A | | 9/1975 | Mangus |
| 4,330,030 | A | | 5/1982 | Cate |
| 4,411,309 | A | | 10/1983 | Kunkel |
| 4,483,392 | A | | 11/1984 | Korsmo et al. |
| 4,513,587 | A | * | 4/1985 | Humpolik ..... F25B 39/02 138/42 |
| 4,522,157 | A | * | 6/1985 | O'Sullivan ..... C10G 9/20 122/367.1 |
| 4,546,822 | A | | 10/1985 | Tamura |
| 4,615,383 | A | | 10/1986 | Hisao |
| 4,653,580 | A | | 3/1987 | Steele |
| 4,664,181 | A | | 5/1987 | Sumberg |
| 4,938,284 | A | | 7/1990 | Howells |
| 5,183,105 | A | | 2/1993 | Adams |
| 5,325,915 | A | | 7/1994 | Fouts et al. |
| 5,540,276 | A | | 6/1996 | Adams et al. |
| 5,551,507 | A | | 9/1996 | Vogel |
| 6,073,686 | A | | 6/2000 | Park et al. |
| 6,116,334 | A | | 9/2000 | Di Tomaso |
| 6,253,839 | B1 | | 7/2001 | Reagen et al. |
| 6,276,445 | B1 | | 8/2001 | Sasano et al. |
| 6,598,295 | B1 | | 7/2003 | Utter |
| 6,820,685 | B1 | | 11/2004 | Carter et al. |
| 7,004,241 | B2 | | 2/2006 | Smithey et al. |
| 7,152,669 | B2 | | 12/2006 | Kroetsch et al. |
| 7,320,360 | B2 | | 1/2008 | Leitch et al. |
| 7,857,038 | B2 | | 12/2010 | Kim et al. |
| 2001/0040026 | A1 | | 11/2001 | Halm |
| 2002/0084064 | A1 | | 7/2002 | Rhodes et al. |
| 2002/0144805 | A1 | | 10/2002 | Kim et al. |
| 2004/0250422 | A1 | | 12/2004 | Ali et al. |
| 2010/0218925 | A1 | | 9/2010 | Candeo |
| 2013/0118724 | A1 | * | 5/2013 | Usui ..... F28D 1/0477 165/181 |

FOREIGN PATENT DOCUMENTS

| | | |
|---|---|---|
| GB | 1114136 | 5/1968 |
| JP | H02208496 A | 8/1990 |
| WO | 20140101215 | 7/2014 |

OTHER PUBLICATIONS

Canadian Patent Office Action for Application No. 2,953,965 dated Jan. 18, 2018 (7 pages).

* cited by examiner

HEAT EXCHANGER INCLUDING COIL END CLOSE-OFF COVER

BACKGROUND

The present invention relates to a heat exchanger assembly, and more particularly, to a plate-fin continuous tube heat exchanger.

Refrigeration systems are well known and widely used in supermarkets and warehouses to refrigerate food product displayed in a product display area of a refrigerated merchandiser or display case. Conventional refrigeration systems include an evaporator, a compressor, and a condenser through which a heat transfer fluid or refrigerant is circulated. Heat transfer between the refrigerant in the evaporator and an airflow passing through the evaporator cools the airflow, which in turn conditions the product display or support area.

Some existing heat exchangers include plate fins and one or more continuous, serpentine refrigerant tubes that pass through slots or 'dog bones' in the fins. Air passing through these existing heat exchangers typically leaks through the slots, and the air leakage through the outermost fins (i.e. the fins on each end of the heat exchanger) generates undesirable turbulence in the airflow and limits effective heat transfer between the refrigerant and the airflow.

SUMMARY

The present invention provides a heat exchanger assembly including a heat exchanger that has a first end and a second end opposite the first end, and a cover coupled to the second end. The heat exchanger includes a plurality of fins with a first fin disposed adjacent the first end and a second fin disposed adjacent the second end, and a continuous, serpentine coil including tube portions extending through axially aligned tube slots in the fins. The coil also includes first return bends projecting beyond the first fin and second return bends projecting beyond the second fin. Each of the first return bends and the second return bends joins two tube portions and configured to direct cooling fluid back through the plurality of fins. The cover has a base plate and separate receptacles encasing one or more of the second return bends to permit airflow through the encased second return bends. The base plate is positioned on the second end to inhibit airflow from one of the receptacles to another of the receptacles.

The present invention also provides a heat exchanger assembly including a heat exchanger that has a first end and a second end opposite the first end, and a plurality of fins spaced apart from each other. Each of the fins has one or more tube slots, and the plurality of fins includes a first fin disposed adjacent the first end and a second fin disposed adjacent the second end. The heat exchanger also includes a continuous, serpentine coil extending through axially aligned tube slots. The coil also has first return bends that project beyond the first fin and second return bends that project beyond the second fin, and each of the first return bends and the second return bends joins two tube portions and configured to direct cooling fluid back through the plurality of fins. The heat exchanger also includes a cover that is coupled to the first end between adjacent first return bends to overlay one or more of the tube slots in the first fin to inhibit airflow through the one or more overlain tube slots.

The present invention also provides a heat exchanger assembly including a heat exchanger that has a first end and a second end opposite the first end. The heat exchanger further has a plurality of fins that are spaced apart from each other, and each of the fins includes one or more tube slots. The plurality of fins has a first fin disposed adjacent the first end and a second fin disposed adjacent the second end. The heat exchanger also includes a continuous, serpentine coil that extends through axially aligned tube slots, and that has first return bends projecting beyond the first fin and second return bends projecting beyond the second fin. Each of the first return bends and the second return bends joins two tube portions and configured to direct cooling fluid back through the plurality of fins. The heat exchanger assembly also has a cover that is snap-fit onto the second end and including a receptacle encasing one or more second return bends to permit airflow through the encased second return bends.

The present invention also provides a cover for a heat exchanger including a plurality of fins and a serpentine coil that defines a continuous refrigerant flow path and that has coil return bends. The cover includes a base plate and separate receptacles oriented and configured to encase one or more return bends to permit airflow through respective encased return bends. The base plate or one or more of the receptacles has an attachment feature that is configured to retain the cover on the heat exchanger without a separate fastener.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
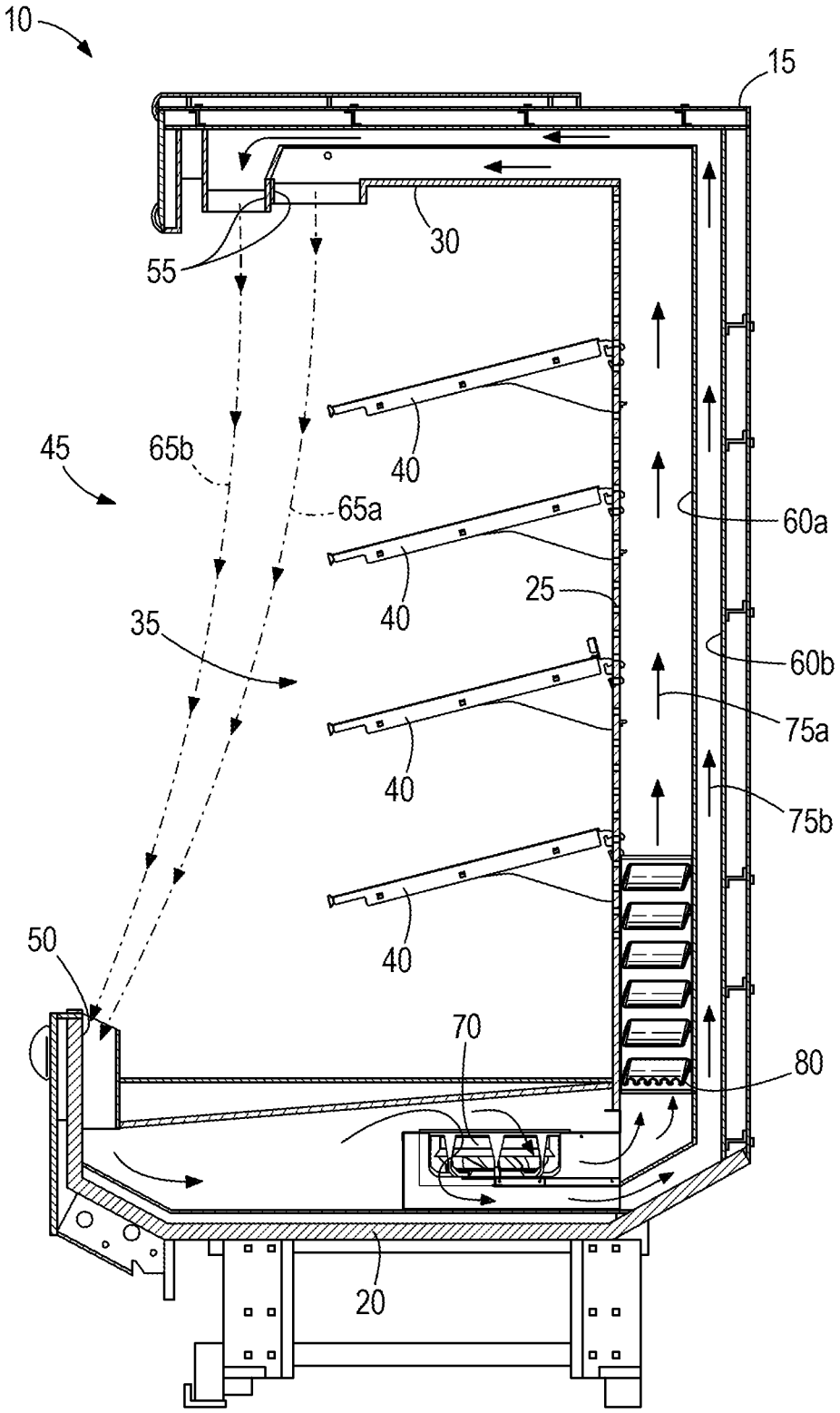
FIG. 1 is a section view of a refrigerated merchandiser including a heat exchanger assembly embodying the present invention.

FIG. 1 illustrates an exemplary refrigerated merchandiser 10 that may be located in a supermarket or a convenience store or other retail setting (not shown) for presenting food, beverages, and other product (not shown). As shown, the merchandiser 10 is an upright merchandiser with an open front. The merchandiser 10 can be provided with or without doors, or the merchandiser may be a horizontal merchandiser with an open or enclosed top, or another type of merchandiser.

The illustrated merchandiser 10 includes a case 15 that has a base 20, a rear wall 25, and a canopy 30. The area partially enclosed by the base 20, the rear wall 25, and the canopy 30 defines a product display area 35 that stores food product in the case 15 (e.g., on shelves 40) and that is accessible through an opening 45 adjacent the front of the case 15. The base 20 includes an air inlet 50 that is located adjacent a lower portion of the opening 45, and an air outlet 55 that is located in the canopy 30. The illustrated case 15 defines two air passageways 60*a*, 60*b* that provide fluid communication between the air inlet 50 and an air outlet 55 to direct air across the product display area 35 in the form of air curtains 65*a*, 65*b*. Generally, the air inlet 50 receives at least some air from one or both air curtains 65*a*, 65*b*. A fan 70 is coupled to the case 15 to generate the airflows (denoted by arrows 75*a*, 75*b*) within the air passageways 60*a*, 60*b*. It will be appreciated that the case 15 can have one or more air passageways directing air to the product display area, and one or more fans to generate each air flow.

Figure 2:
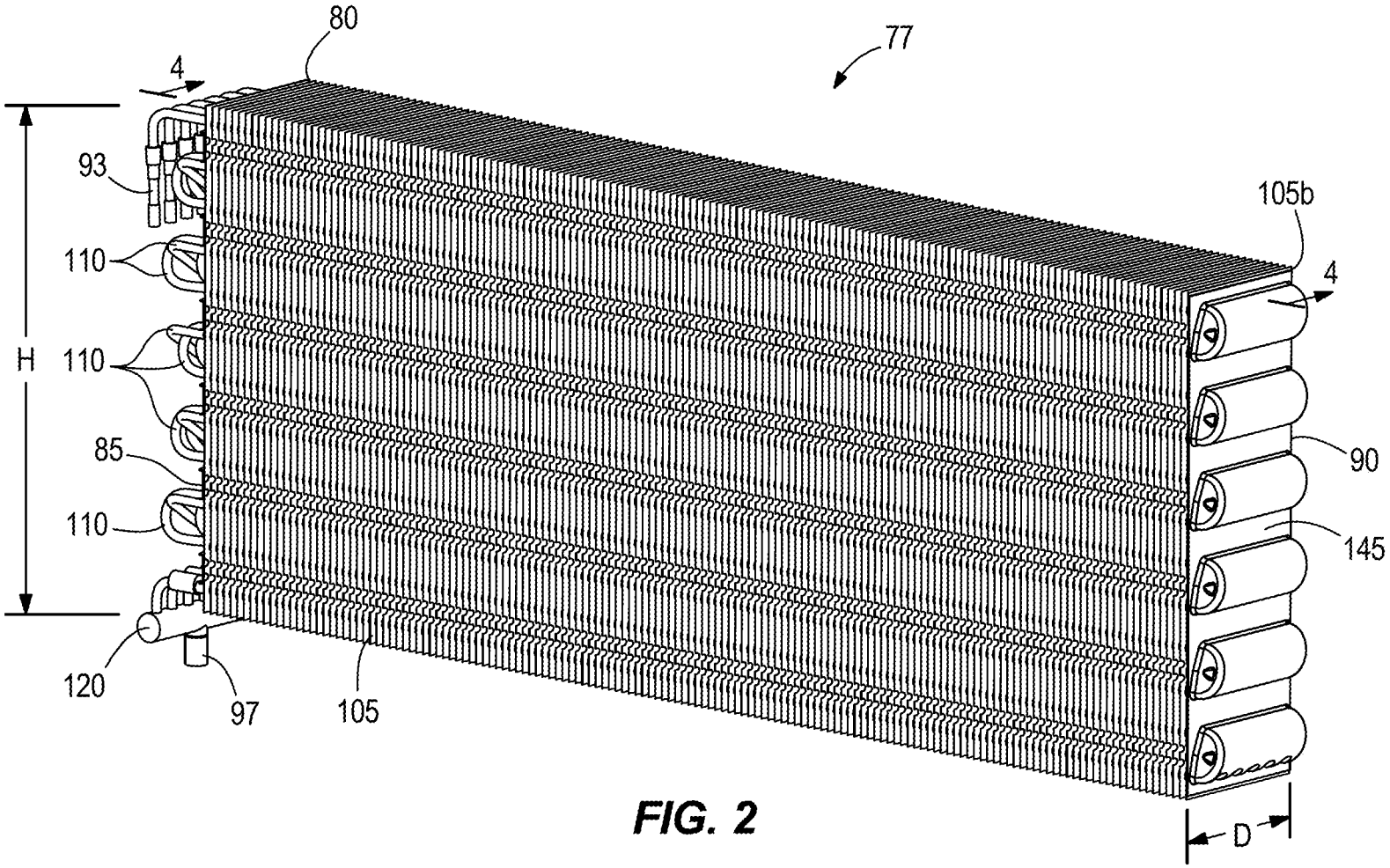
FIG. 2 is a perspective view of the heat exchanger assembly of FIG. 1, illustrating a heat exchanger and a first end cover coupled to a first end of the heat exchanger.
Figure 3:
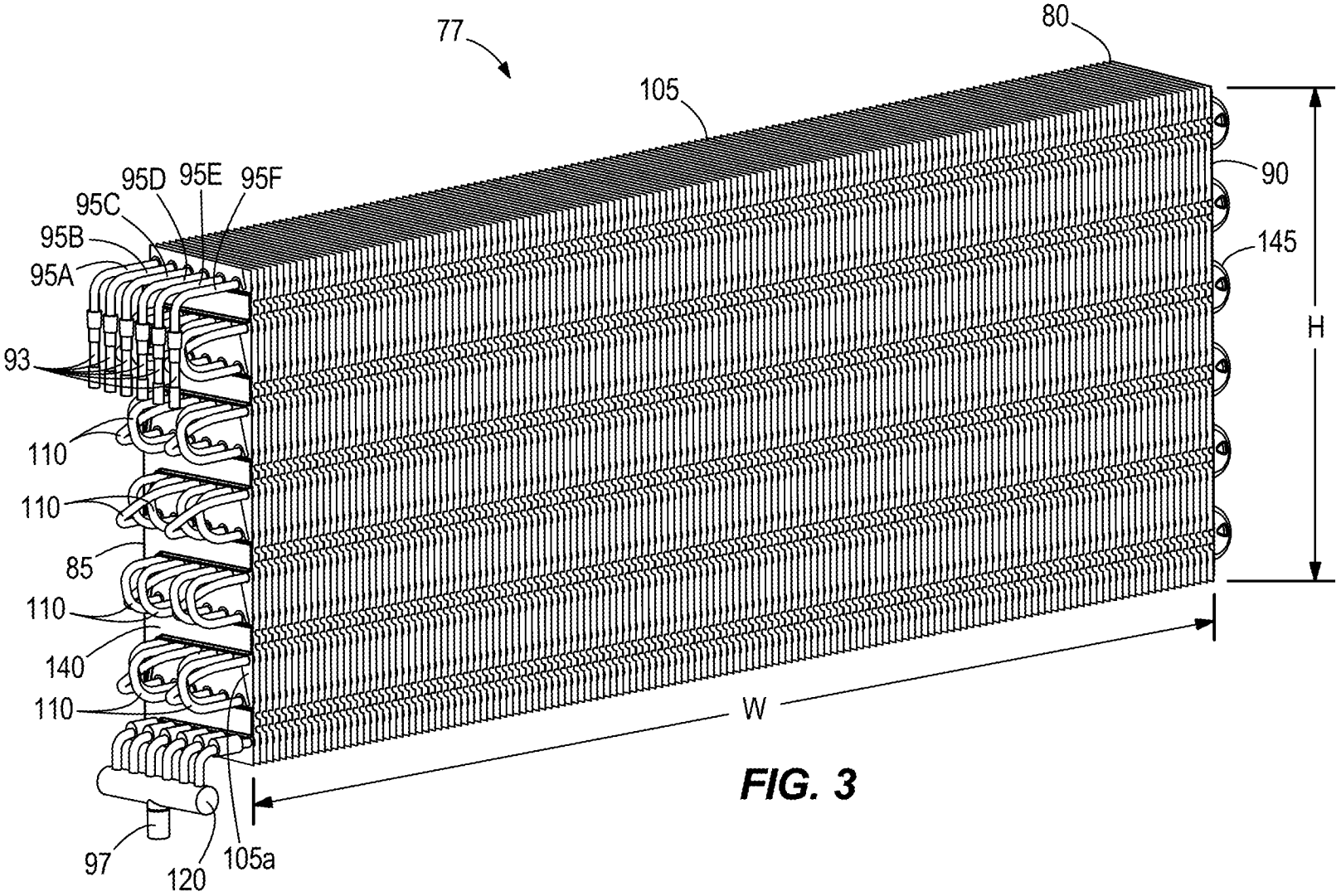
FIG. 3 is another perspective view of the heat exchanger assembly of FIG. 1, illustrating a second end cover coupled to a second end of the heat exchanger.

With reference to FIGS. 1-3, the merchandiser 10 includes at least a portion of a refrigeration system (not entirely shown) that circulates a heat transfer fluid (e.g., refrigerant, coolant, etc.) to refrigerate product supported in the product display area 35. More specifically, the refrigeration system includes a heat exchanger assembly 77 with a heat exchanger or evaporator 80 (referred to herein as an "evaporator" for purposes of description only) that is fluidly coupled to a compressor and a condenser to receive cooled heat transfer fluid (e.g., refrigerant) from the condenser and to direct the heat transfer fluid to the compressor. As will be understood and appreciated by one of ordinary skill in the art, the evaporator 80 transfers heat from the airflow 75*a* to the heat transfer fluid flowing through the evaporator 80. Operation of the refrigeration system is well known and, as such, will not be discussed in detail.

Figure 5:
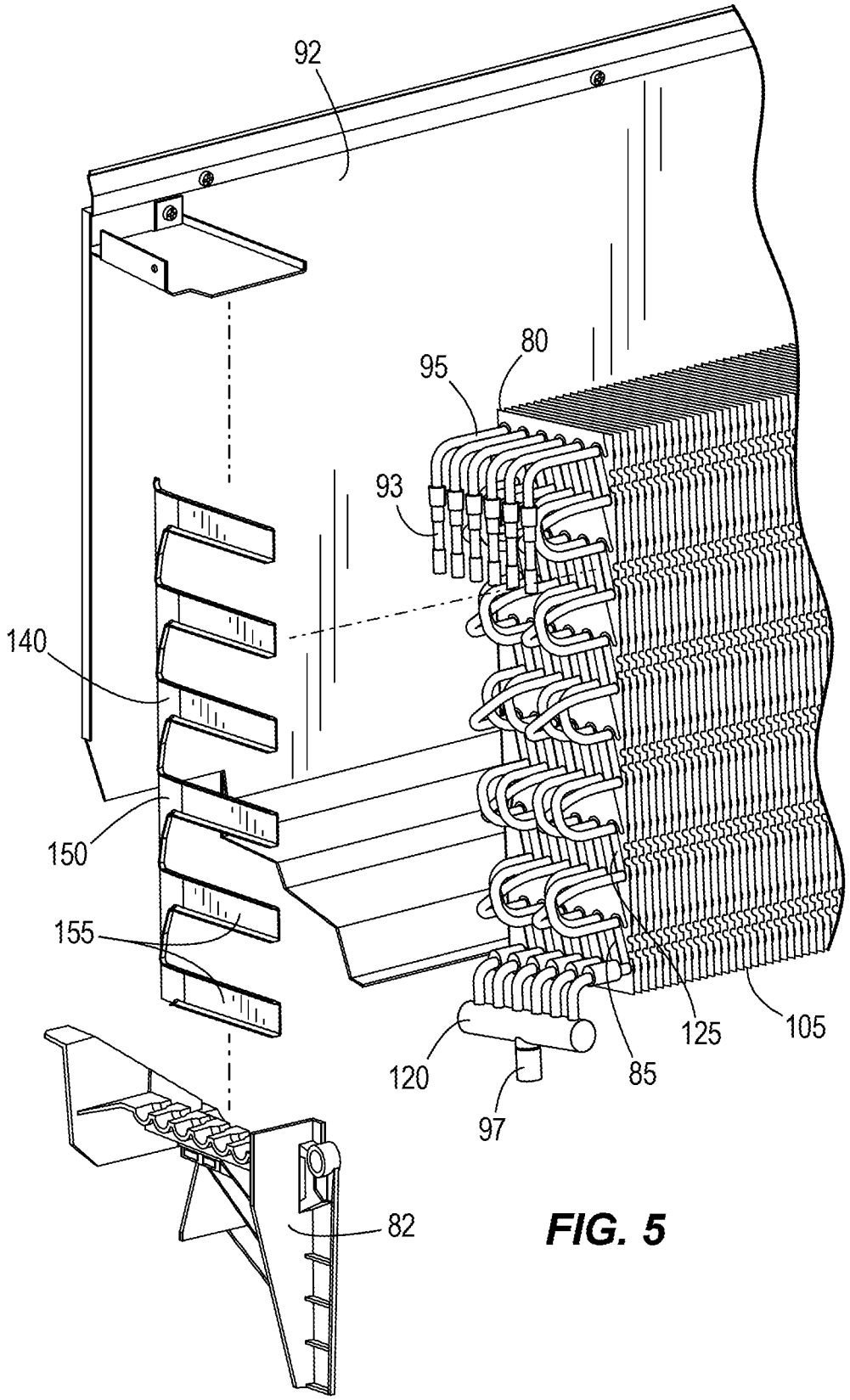
FIG. 5 is an exploded perspective view of the heat exchanger assembly of FIG. 3 and portions of the merchandiser of FIG. 1.
Figure 6:
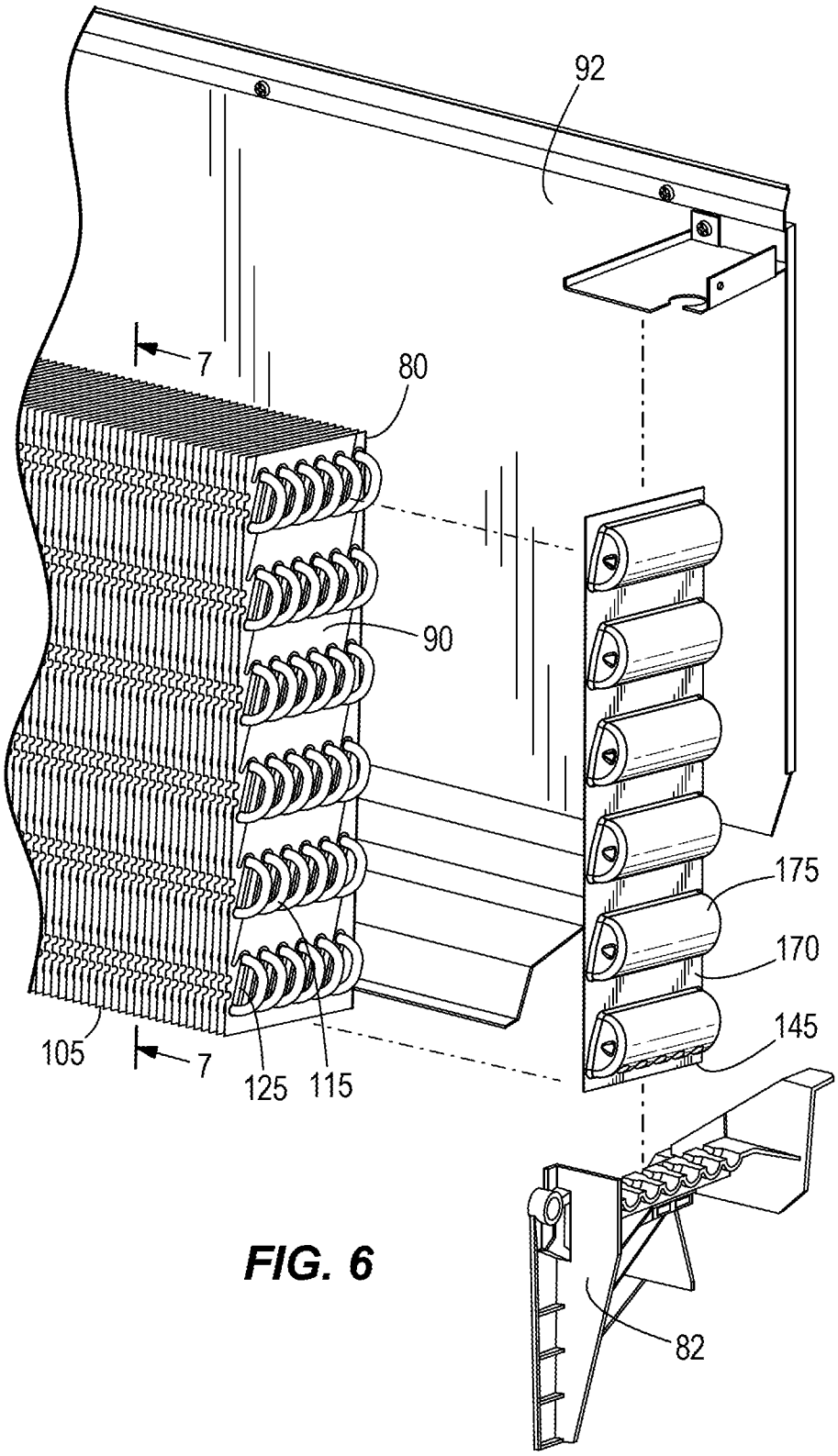
FIG. 6 is another exploded perspective view of the heat exchanger assembly of FIG. 3 and the portions of the merchandiser of FIG. 1.

With reference to FIGS. 1, 5, and 6, the evaporator 80 is supported in the case 15 within the passageway 60*a* via coil supports 82 that are positioned adjacent respective first and second ends 85, 90 of the evaporator 80. The coil supports 82 also can support or be coupled to a portion of a wall 92 that defines part of the passageway 60*a*. In the orientation of the evaporator 80 that is illustrated in FIG. 1, the evaporator 80 is upright such that the airflow 75 passes substantially vertically along a height H through the evaporator 80 (see FIGS. 2 and 3; the evaporator 80 also has a depth D and a width W).

Referring to FIGS. 3, 5, and 6, the illustrated evaporator 80 can be divided along its depth D into several zones or tube circuits. Each zone delineates an airflow section of the evaporator 80 that receives a portion of the airflow 75*a*. At the first end 85 of the evaporator 80, one or more inlet ports 93 direct heat transfer fluid to one or more serpentine coils 95 (six coils 95A-F are shown in FIG. 3). Although the evaporator 80 includes six zones and six coils 95A-F, heat exchangers with fewer or more than six zones and six coils are possible and considered. An exemplary heat exchanger with several zones or tube circuits includes the heat exchanger manufactured by Hussmann Corporation (Bridgeton, Mo.) and embodied in U.S. patent application Ser. No. 13/768,238 (assigned to Hussmann Corporation), the entire contents of which are incorporated by reference herein. The horizontal and/or vertical spacing between the coils can be modified based on desired heat exchanger properties. Other tube patterns also can be incorporated into the heat exchanger (e.g., inline, staggered, angled, etc.). The coils 95 can be formed from any suitable material (e.g., metal such as an aluminum alloy or copper).

The quantity of inlet ports 93 can be independent of the quantity of coils 95 (e.g., there can be the same quantity of inlet ports 93 and coils 95, or there can be fewer or more inlet ports 93 than coils 95) depending on the quantity of tube circuits in the evaporator 80. Each coil 95 is continuous between the inlet port 93 and an outlet port 97. As illustrated, the coils 95 extend between the first end 85 and the second end 90 in a serpentine arrangement between the inlet port 93 and the outlet port 97.

As illustrated in FIGS. 2-6, the coils 95A-F have tube sections 100 that extend between the first end 85 and the second end 90 and that pass through a plurality of generally equally spaced, substantially parallel fins 105. At the first end 85, return bend portions 110 for the six coils 95A-F project from or beyond an end fin 105*a* and join or interconnect adjacent tube sections 100 to route the refrigerant back through the evaporator 80. At the second end 90, return bend portions 115 for each of the coils 95A-F project from or beyond another end fin 105*b* that is on the opposite side of the evaporator 80 relative to the end fin 105*a*. The return bend portions 115 join or interconnect adjacent tube sections 100 on the second end 90 to route refrigerant back through the evaporator 80. An outlet manifold 120 located adjacent the first end 85 collects heat transfer fluid that has flowed the length of the coils 95A-F and directs the fluid to the outlet port 97 for recirculation through the refrigerant system. As will be appreciated, one or more of the return bend portions 110, 115 can switch zones or laterally crossover other bend portions on the same end of the evaporator 80. Such crossover of the coils is described and illustrated in detail in patent application Ser. No. 13/768,238, which is assigned to Hussmann Corporation.

Figure 7:
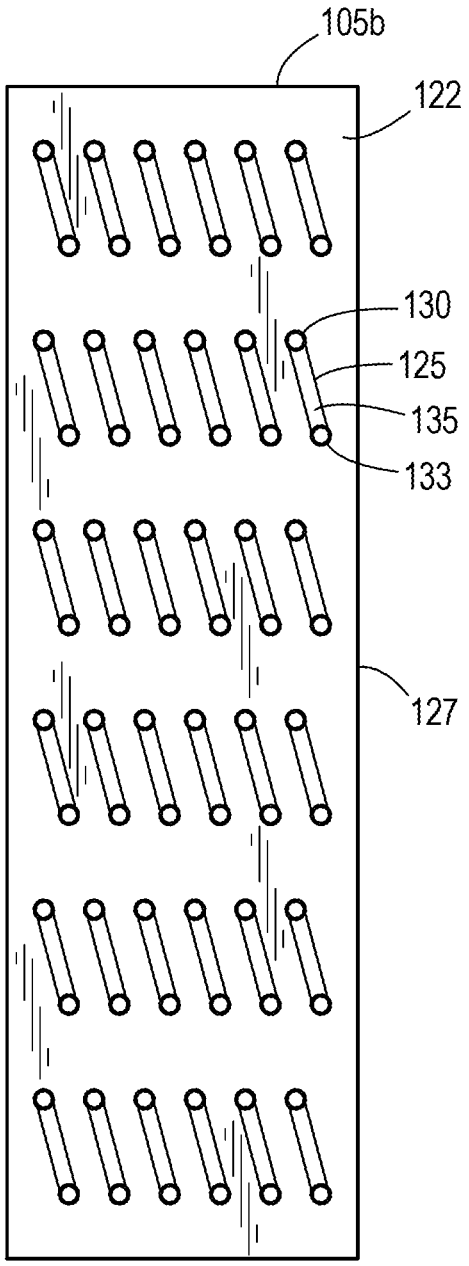
FIG. 7 is a section view of the heat exchanger of FIG. 6 taken along line 7-7.

FIG. 7 shows the orientation of the coils 95A-F adjacent an inner side of the end fin 105*b*. The end fin 105*b* is formed from a plate 122 that has a plurality of "dog bone" slots 125. Each dog bone slot 125 is angled with respect to a lateral edge 127 of the plate 122, and includes a first tube orifice 130 and a second tube orifice 133 that are connected by an elongated aperture 135. The tube slots 125 illustrated of the end fin 105*b* are exemplary of the tube slots 125 (in structure and orientation) for all fins 105. In other words, the fins 105 have the same arrangement of tube slots 125.

With reference to FIGS. 4-6 and 8-11, the heat exchanger assembly 77 also includes an end cover 140 that is coupled to the first end 85, and another end cover 145 that is coupled to the second end 90. Each of the end covers 140, 145 is defined by a monolithic component that can include plastic, composite, metallic, or other materials. For example, the end covers 140, 145 can be formed from thin plastic material that is vacuum-thermoformed into a desired shape or profile (e.g., to conform to the spacing between return bend portions 100, to conform to the return bend portions 115, etc.).

Figure 4:
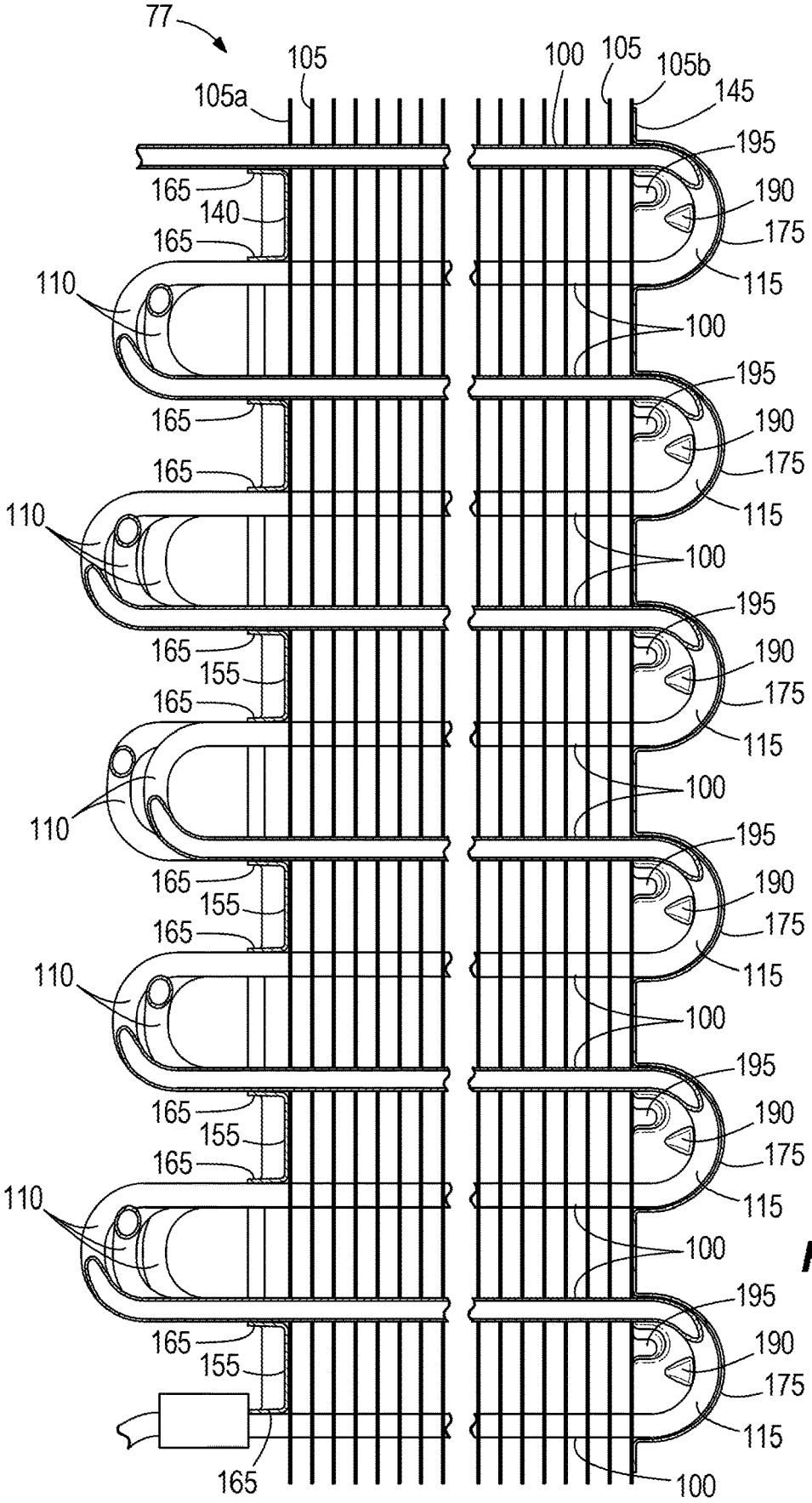
FIG. 4 is a section view of a portion of the heat exchanger of FIG. 2 taken along line 4-4.
Figure 8:
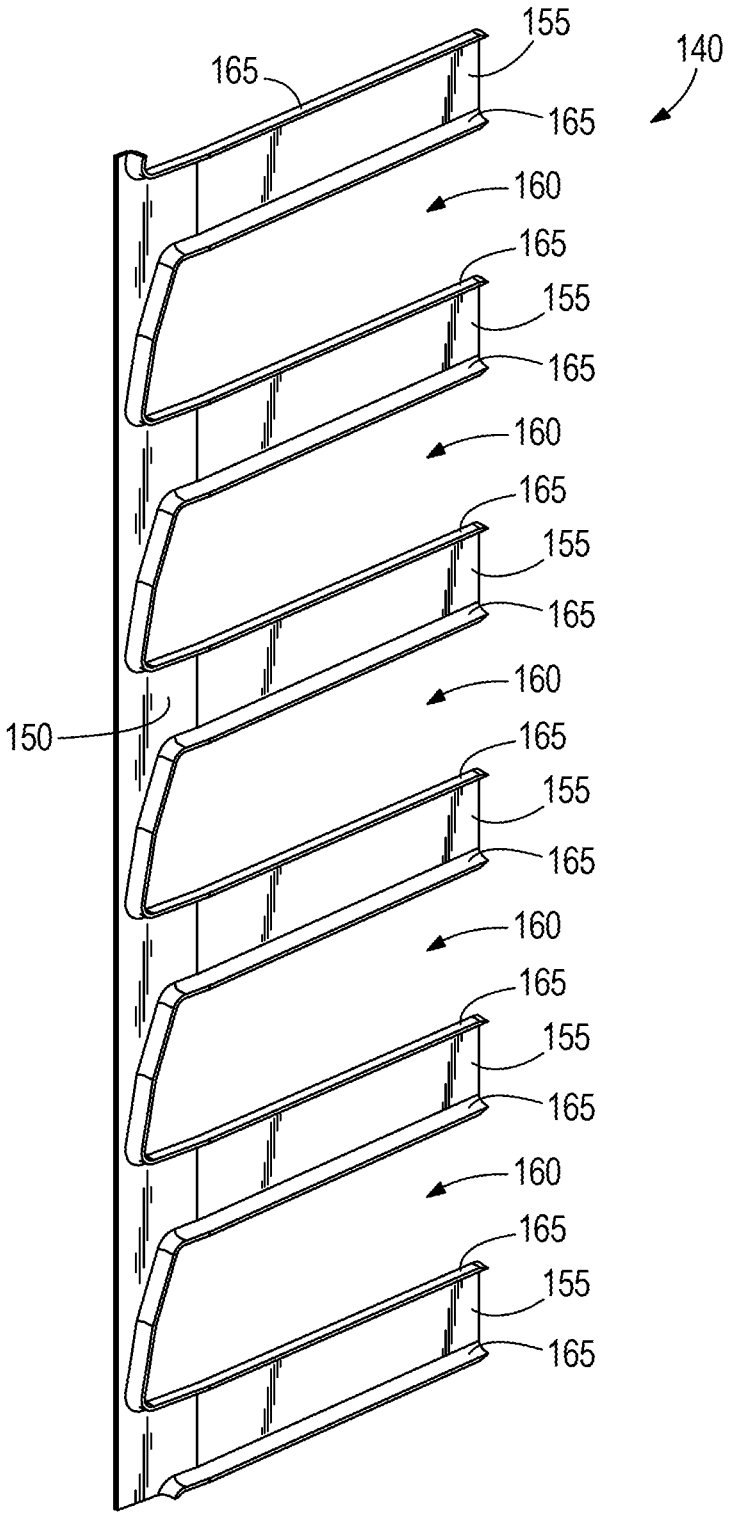
FIG. 8 is a perspective view of the first end cover.

As illustrated in FIGS. 4 and 8, the end cover 140 has a base plate 150 with finger-like extensions 155 that are spaced apart from each other in the longitudinal direction of the cover 140 to define gaps 160. Flanges or lips 165 project from the longitudinal edges of the extensions 155 and are engageable with the coils 95A-F in a tight-fitting (e.g., interference fit or friction fit) arrangement adjacent the return bend portions 110.

Figure 9:
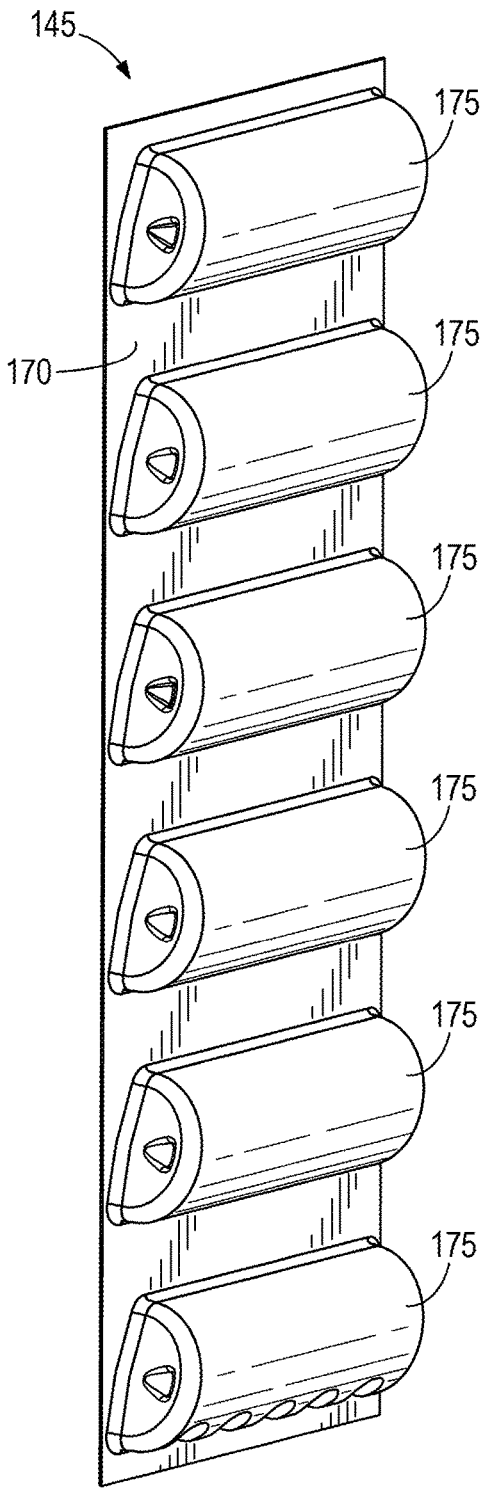
FIG. 9 is a perspective view of the second end cover.
Figure 10:
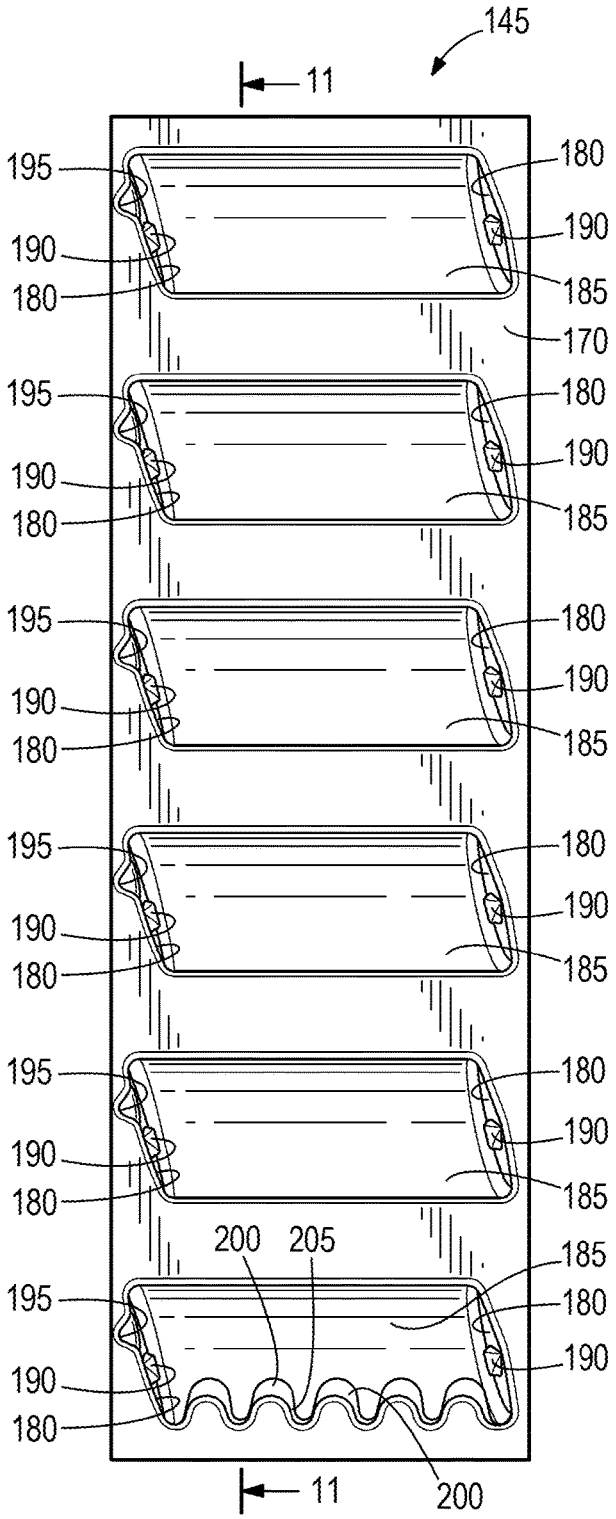
FIG. 10 is a view of the first end cover of FIG. 9, illustrating the evaporator-facing side of the first end cover.
Figure 11:
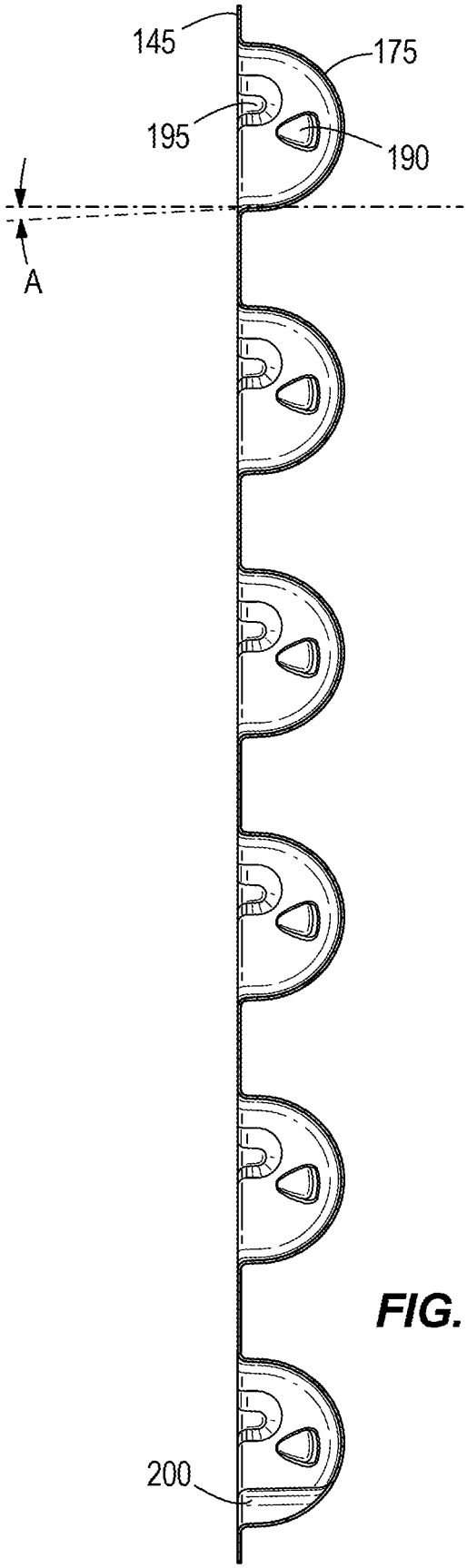
FIG. 11 is a section view of the first end cover of FIG. 10, taken along line 11-11.

Referring to FIGS. 4, and 9-11, the end cover 145 has a base plate 170 and pockets or receptacles 175 that are disposed in the base plate 170. The receptacles 175 are spaced apart from each other along the base plate 170 such that the receptacles 175 align vertically (i.e. along the height H) with the return bend portions 115 when the end cover 145 is attached to the heat exchanger 80. Each receptacle 175 has opposite side walls 180 and a recessed or base wall 185 that interconnects the side walls 180. The side walls 180 are shaped or angled to conform to the shape of each row of return bend portions 115. As illustrated in FIG. 10, the side walls 180 are angled relative to vertical (i.e. leftward in FIG. 10) to conform to the angle of the return bend portions 115 (FIG. 7 illustrates the angle or orientation of tube section pairs, which corresponds to the orientation or angle of the return bend portions 115 when considered in the context of what is shown in FIG. 6). As will be appreciated, the return bend portions 115 and the side walls 180 can have different corresponding orientations (e.g., vertical or angled to the right as viewed in FIG. 10). The quantity of receptacles 175 corresponds to the quantity of rows of return bend portions 115 (six receptacles 175 are illustrated in FIGS. 9-11, corresponding to six rows of return bend portions 115), although the end cover 145 may have fewer receptacles 175 than return bend rows (e.g., two or more return bend rows may be disposed in the same receptacle).

As illustrated, each side wall 180 includes an attachment feature 190 that is engageable with the outermost return bend portions 115 of each row of return bend portions 115 to facilitate attachment of the end cover 145 to the heat exchanger 80 without separate fasteners. FIGS. 9-11 illustrate that the attachment feature 190 is defined by a detent or projection that protrudes inward from the side walls 180, although other attachment features are possible and considered herein. As shown, the detent is wedge-shaped (with the narrowest portion oriented toward the opening to the receptacle 175) to permit snap-fit attachment of the end cover 145 to the heat exchanger 80. Although the end cover 145 includes the attachment feature 190 on each side wall 180, it will be appreciated that the attachment feature can be provided on fewer than all of the side walls 180. For example, the attachment features 190 can be arranged in an alternating pattern such that one side wall 180 of each receptacle 175 includes the attachment feature 190, with the attachment features 190 of adjacent receptacles 175 provided on opposite side walls 180 (i.e. the locations of the attachment features 190 on the side walls 180 defines a zig-zag pattern along the height of the end cover 145). In another example, fewer than all receptacles 175 (e.g., one receptacle 175) may include one or more attachment features 190 (e.g., one attachment feature 190 on a single side wall 180, an attachment feature 190 on each side wall 180 of the single receptacle 175). With reference to FIGS. 10 and 11, one side wall 180 of each receptacle 175 also includes a channel 195 to permit drainage of condensation that may form on the return bend portions 115.

With reference to FIGS. 9 and 11, the illustrated wall 185 is curved and generally has a cylindrical or nearly cylindrical shape that conforms to the curvature of the return bend portions 115 so that the end cover 145 has a close-fitting or tight-fitting arrangement with the heat exchanger 80 (see FIG. 4). As shown in FIG. 11, the lower edge of each wall 185 is angled downward (e.g., 1-10 degrees) relative to horizontal (i.e. defined by angle A) to permit drainage of condensation from the receptacle 175 and to allow airflow through or within each receptacle 175. Referring to FIG. 10, the wall 185 of the lowermost receptacle 175 also includes raised sections 200 that are separated by recesses 205. The recesses 205 formed between the raised sections 200 accommodate and generally conform to part of the return bend portions 115 in the lowermost row of return bend portions 115 on the second end 90 to assist with retaining the end cover 145 on the heat exchanger 80.

Figure 12:
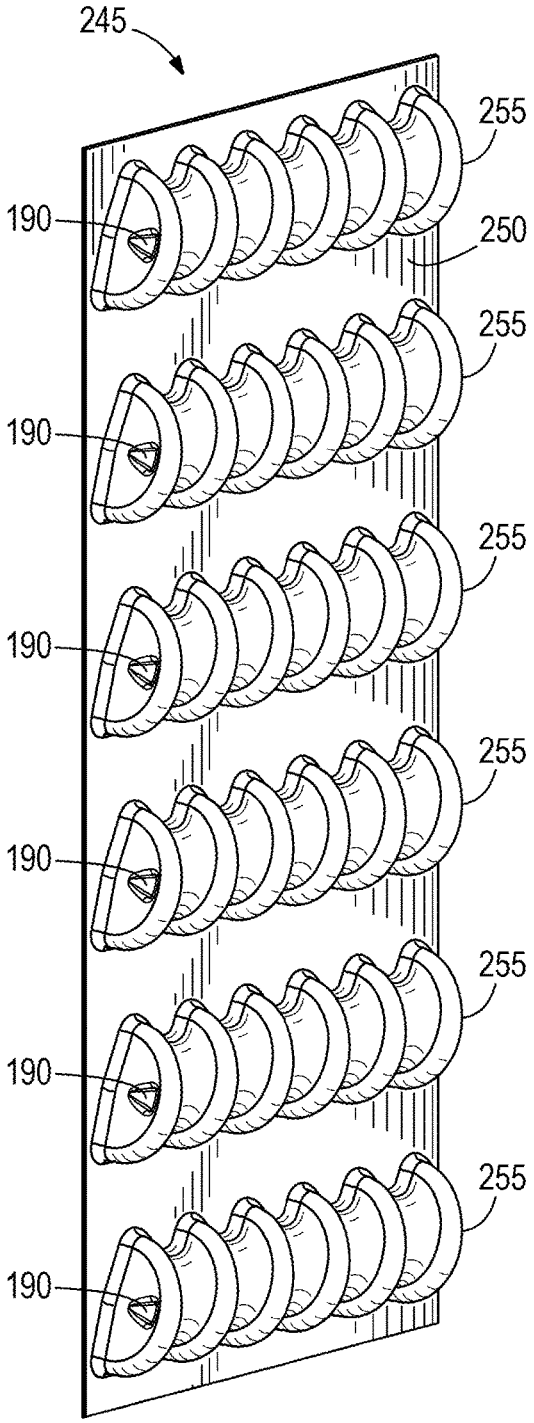
FIG. 12 is a perspective view of another exemplary end cover for the heat exchanger assembly.
Figure 13:
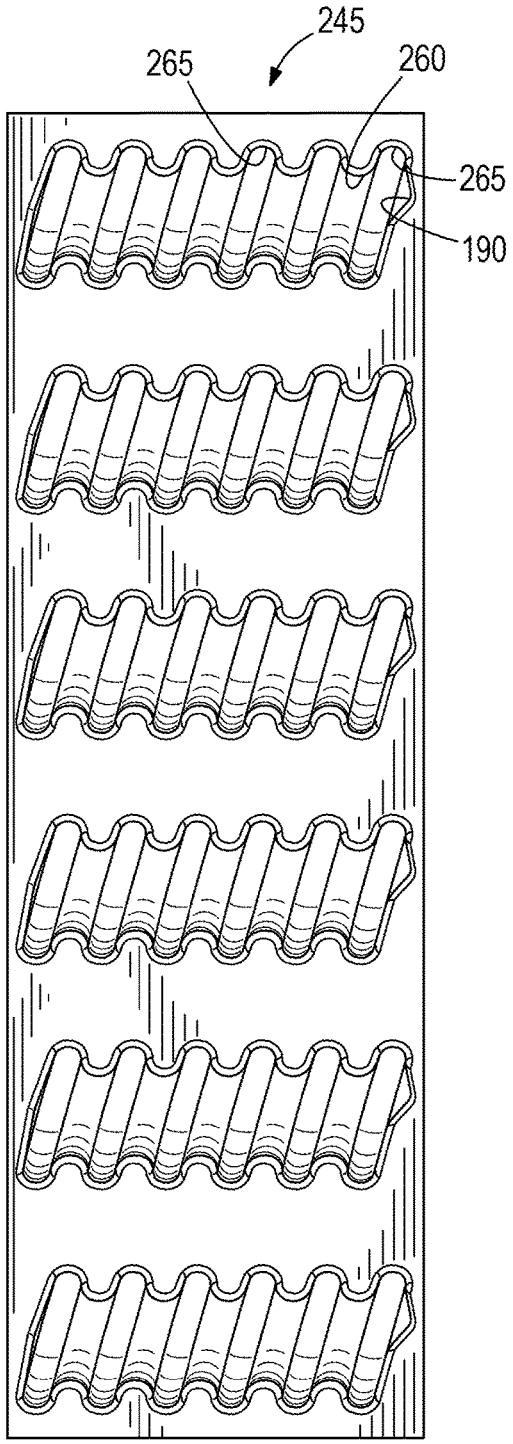
FIG. 13 is a view of the end cover of FIG. 12, illustrating the evaporator-facing side of the end cover.

FIGS. 12 and 13 illustrate another end cover 245 that can be attached to the second end 90 in lieu of the end cover 145. The end cover 245 has a base plate 250 and pockets or receptacles 255 that are disposed in the base plate 250. The receptacles 255 are the same as the receptacles 180, except that each receptacle 255 defines a recessed wall 260 with discrete return bend pockets 265 that are interconnected with adjacent return bend pockets 265 by wall portions 270.

Referring to FIGS. 3-5, the end cover 140 is attached to the first end 85 by positioning the extensions 155 over the slots 125 in the end fin 105*a*. This can be accomplished in one of two primary ways. In one example, the end cover 140 is assembled onto the heat exchanger 80 by sliding or inserting the extensions 155 laterally in the direction defining the depth D of the heat exchanger 80. In this example, the flanges 165 slide across the return bend portions 110 until the interior edges of the gaps 160 abut or nearly abut the return bend portions 110 that are disposed adjacent the edge of the end fin 105*a*. In another example, the end cover 140 is assembled onto the heat exchanger 80 by positioning the end cover 140 over and aligned with the slots 125 across or along the depth D. In this second example, the flanges 165 slide axially along the return bend portions 110 (i.e. axially along the width W) of the heat exchanger 80 until the extensions 155 abut or nearly abut the end fin 105*a*. The interior edges of the gaps 160 are generally aligned with the return bend portions 110 that are disposed adjacent the edge of the end fin 105*a*. In either example, the end cover 140 is retained in engagement with the heat exchanger 80 via the tight-fitting or friction-fitting arrangement between the flanges 165 and the return bend portions 110.

Referring to FIGS. 2, 4, and 6, the end cover 145 is attached to the second end 85 by positioning the end cover 145 over the end fin 105*b* so that the receptacles 175 are aligned with the rows of return bend portions 115. The end cover 145 is then moved axially along the width direction until the attachment features 190 (e.g., detents) engage the outermost return bend portions 115. At this point, the end cover 145 is retained in engagement with the heat exchanger 80 via the snap-fit arrangement provided by the attachment features 190 and the outermost return bend portions 115. As shown in FIG. 4, the return bend portions 115 are nested in the end cover 145. When assembled, the channels 190 are positioned adjacent the uppermost part of the respective return bend portions 115 to facilitate drainage of condensation through or from each receptacle 175. The angular orientation of the wall 185 in each receptacle 175 assists with drainage generally downward through the heat exchanger 80 along the end fin 105*b*. The end cover 245 is attached to the heat exchanger 80 in the same manner, the primary difference being that the return bend portions 115 are nested in respective pockets 265.

When assembled, the end covers 140, 145, 245 enclose or substantially enclose the elongated apertures 137 of the tube slots 125 on each end fin 105*a*, 105*b*. The end cover 140 inhibits airflow exiting through the end fin 105*a*. The receptacles 175 of the end cover 145, 245 encapsulate the respective rows of the return bend portions 115 to permit air circulation through each encapsulated row and to and from the interior of the heat exchanger 80 while preventing or insulating air circulation between the rows due to engagement or close proximity of the base plate 150 relative to the end fin 105*b*. Stated another way, the base plate 150 seals or nearly completely seals the airflow path and confines the airflow in large part (or completely) to the interior of the heat exchanger 80 to promote airflow generally along the height H of the heat exchanger 80. The shape of the receptacles 175 and the channels 190 control or minimize the quantity of water or condensation that can be retained in each receptacle 175 (e.g., during defrost of the heat exchanger 80) and to direct or guide the flow of water or condensation toward the bottom of the heat exchanger 80.

Various features and advantages of the invention are set forth in the following claims.

The invention claimed is:

1. A heat exchanger assembly comprising:

a heat exchanger including a first end and a second end opposite the first end, the heat exchanger further including a plurality of fins spaced apart from each other, each of the fins including one or more tube slots, and the plurality of fins including a first fin disposed adjacent the first end and a second fin disposed adjacent the second end; and a continuous, serpentine coil including tube portions extending through axially aligned tube slots, the coil also including first return bends projecting beyond the first fin and second return bends projecting beyond the second fin, each of the first return bends and the second return bends joining two tube portions and configured to direct cooling fluid back through the plurality of fins; and a cover coupled to the second end, the cover including a base plate and separate receptacles, each receptacle oriented and encasing one or more of the second return bends to permit airflow through the encased second return bends, the base plate positioned on the second end to inhibit airflow from one of the receptacles to another of the receptacles, wherein one or more of the receptacles has an attachment feature including a detent engageable with at least one of the second return bends to retain the cover on the second end of the heat exchanger without a separate fastener.

2. The heat exchanger assembly of claim 1, wherein the base plate is in contact with the second fin.

3. The heat exchanger assembly of claim 1, wherein each of the receptacles is curved to conform to the curvature of the encased second return bends.

4. The heat exchanger assembly of claim 1, wherein the detent protrudes inward from a wall of one of the receptacles.

5. The heat exchanger assembly of claim 1, wherein each of the receptacles has opposite side walls and a base wall extending between the side walls, and wherein the side walls of one or more of the receptacles includes the attachment feature.

6. The heat exchanger assembly of claim 1, wherein each of the receptacles has opposite side walls and a base wall extending between the side walls, wherein the end wall is angled downward and one or both of the side walls has a channel, and wherein the end wall and the channel are cooperatively configured to drain condensation from each of the receptacles.

7. The heat exchanger assembly of claim 1, wherein one or more of the receptacles has a downwardly-sloped profile configured to drain condensation from the receptacle.

8. The heat exchanger assembly of claim 1, wherein one or more of the receptacles includes pockets shaped to conform to the second return bends.

9. The heat exchanger assembly of claim 1, wherein the cover is a first cover and the heat exchanger assembly includes a second cover coupled to the first end to close off one or more of the tube slots in the first fin.

10. The heat exchanger assembly of claim 9, wherein the second cover includes a base plate having a plurality of extensions extending across the first fin and disposed between first return bends that project beyond the first fin at different elevations on the heat exchanger.

11. A heat exchanger assembly comprising:

a heat exchanger including a first end and a second end opposite the first end, the heat exchanger further including a plurality of fins spaced apart from each other, each of the fins including one or more tube slots, and the plurality of fins including a first fin disposed adjacent the first end and a second fin disposed adjacent the second end; and a continuous, serpentine coil extending through axially aligned tube slots, the coil also including first return bends projecting beyond the first fin and second return bends projecting beyond the second fin, each of the first return bends and the second return bends joining two tube portions and configured to direct cooling fluid back through the plurality of fins;

a first cover coupled to the first end between adjacent first return bends to overlay one or more of the tube slots in the first fin to inhibit airflow through the one or more overlain tube slots; and a second cover coupled to the second end, the second cover including a base plate, separate receptacles, each receptacle oriented and encasing one or more of the second return bends to permit airflow through the encased second return bends, wherein one or more of the receptacles has an attachment feature including a detent engageable with at least one of the second return bends to retain the second cover on the second end of the heat exchanger without a separate fastener.

12. The heat exchanger assembly of claim 11, wherein the first cover includes a base plate having a plurality of extensions extending across the first fin and disposed between first return bends that project beyond the first fin at different elevations on the evaporator.

13. The heat exchanger assembly of claim 12, wherein the first cover further includes flanges extending from the extensions and engaged with a portion of the first return bends to retain the first cover on the first end.

14. A heat exchanger assembly comprising:

a heat exchanger including a first end and a second end opposite the first end, the heat exchanger further including a plurality of fins spaced apart from each other, each of the fins including one or more tube slots, and the plurality of fins including a first fin disposed adjacent the first end and a second fin disposed adjacent the second end; and a continuous, serpentine coil extending through axially aligned tube slots, the coil also including first return bends projecting beyond the first fin and second return bends projecting beyond the second fin, each of the first return bends and the second return bends joining two tube portions and configured to direct cooling fluid back through the plurality of fins; and a cover snap-fit onto the second end and including a base plate, and a receptacle encasing one or more second return bends to permit airflow through the encased second return bends, wherein the receptacle has an attachment feature including a detent engageable with at least one of the second return bends to retain the cover on the second end of the heat exchanger without a separate fastener.

15. The heat exchanger assembly of claim 14, wherein the receptacle is curved to conform to the curvature of the encased second return bends, the curvature of the receptacle configured to drain condensation from the receptacle.

16. A cover for a heat exchanger, the heat exchanger including a plurality of fins and a serpentine coil defining a continuous refrigerant flow path and having coil return bends, the cover comprising:

a base plate; and separate receptacles, each receptacle oriented and configured to encase one or more return bends to permit airflow through respective encased return bends, wherein one or more of the receptacles has an attachment feature including a detent engageable with at least one of the coil return bends and configured to retain the cover on the heat exchanger without a separate fastener.

17. The cover of claim 16, wherein the base plate is configured to contact one of the plurality of fins.

18. The cover of claim 16, wherein each of the receptacles is configured to curve to conform to at least one or more of the respective encased return bends.

19. The cover of claim 18, wherein the curvature of each of the receptacles is configured to drain condensation from the respective receptacle.

20. The cover of claim 16, wherein the detent protrudes inward from a wall of one of the receptacles.

21. The cover of claim 16, wherein each of the receptacles has opposite side walls and a base wall extending between the side walls, and wherein the side walls of one or more of the receptacles includes the attachment feature.

22. The cover of claim 16, wherein each of the receptacles has opposite side walls and a base wall extending between the side walls, wherein the end wall is angled downward and one or both of the side walls has a channel, and wherein the end wall and the channel are cooperatively configured to drain condensation from each of the receptacles.

23. The cover of claim 16, wherein one or more of the receptacles has a downwardly-sloped profile configured to drain condensation from the receptacle.

24. The cover of claim 16, wherein one or more of the receptacles includes pockets, wherein each pocket is configured to be shaped to conform to at least one or more of the respective encased return bends.

25. The cover of claim 16, wherein the cover is configured to snap-fit onto the heat-exchanger.

26. The cover of claim 16, wherein the base plate is configured to be positioned on an end of the heat exchanger to inhibit airflow from one of the receptacles to another of the receptacles.

* * * * *